United States Patent [19]

Germani

[11] 4,100,944

[45] Jul. 18, 1978

[54] METHOD AND APPARATUS FOR TRANSFERRING THE WEFT

[75] Inventor: Cesare Germani, Como, Italy

[73] Assignee: Omita S.p.A., Italy

[21] Appl. No.: 721,312

[22] Filed: Sep. 7, 1976

[30] Foreign Application Priority Data

Sep. 19, 1975 [CH] Switzerland ..... 12184/75

[51] Int. Cl.[2] ..... D03D 47/24

[52] U.S. Cl. ..... 139/439; 139/450

[58] Field of Search ..... 139/435, 437, 438, 439, 139/450, 18

[56] References Cited

U.S. PATENT DOCUMENTS

| | | | |
|---|---|---|---|
| 3,378,040 | 4/1968 | Moessinger | 139/439 |
| 3,416,572 | 12/1968 | Giavini | 139/450 |
| 3,430,666 | 3/1969 | Freihofer | 139/450 |
| 3,796,236 | 3/1974 | Kamp | 139/450 |

FOREIGN PATENT DOCUMENTS

| | | | |
|---|---|---|---|
| 1,098,802 | 1/1968 | United Kingdom | 139/439 |

*Primary Examiner*—Henry S. Jaudon

*Attorney, Agent, or Firm*—Weingarten, Maxham & Schurgin

[57] ABSTRACT

A method and apparatus for controlling and transferring the cut end of a weft to a subsequent sliding shuttle clamp. The weft end is retained in the guide slot of the shuttle supply drum which was occupied by the previous shuttle before it was shot through the shed. A storage lever retracts the cut end of the weft to the intake side of the drum and the weft is then pivoted to the new shuttle.

6 Claims, 6 Drawing Figures

FIG. 2
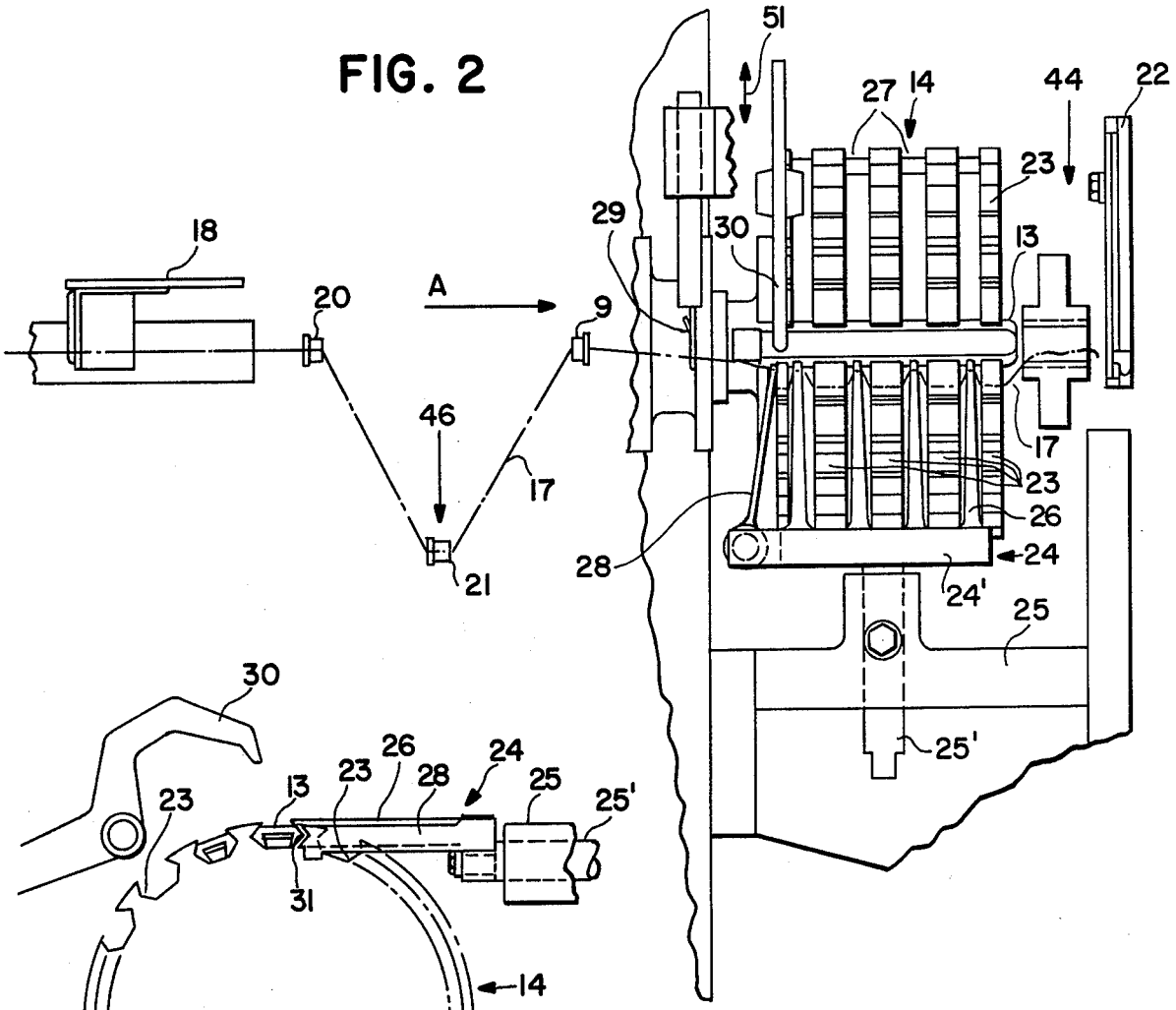
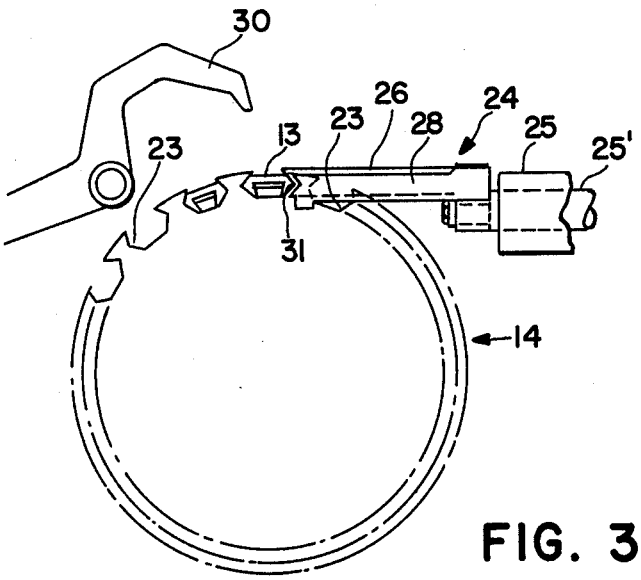
FIG. 3

FIG. 4
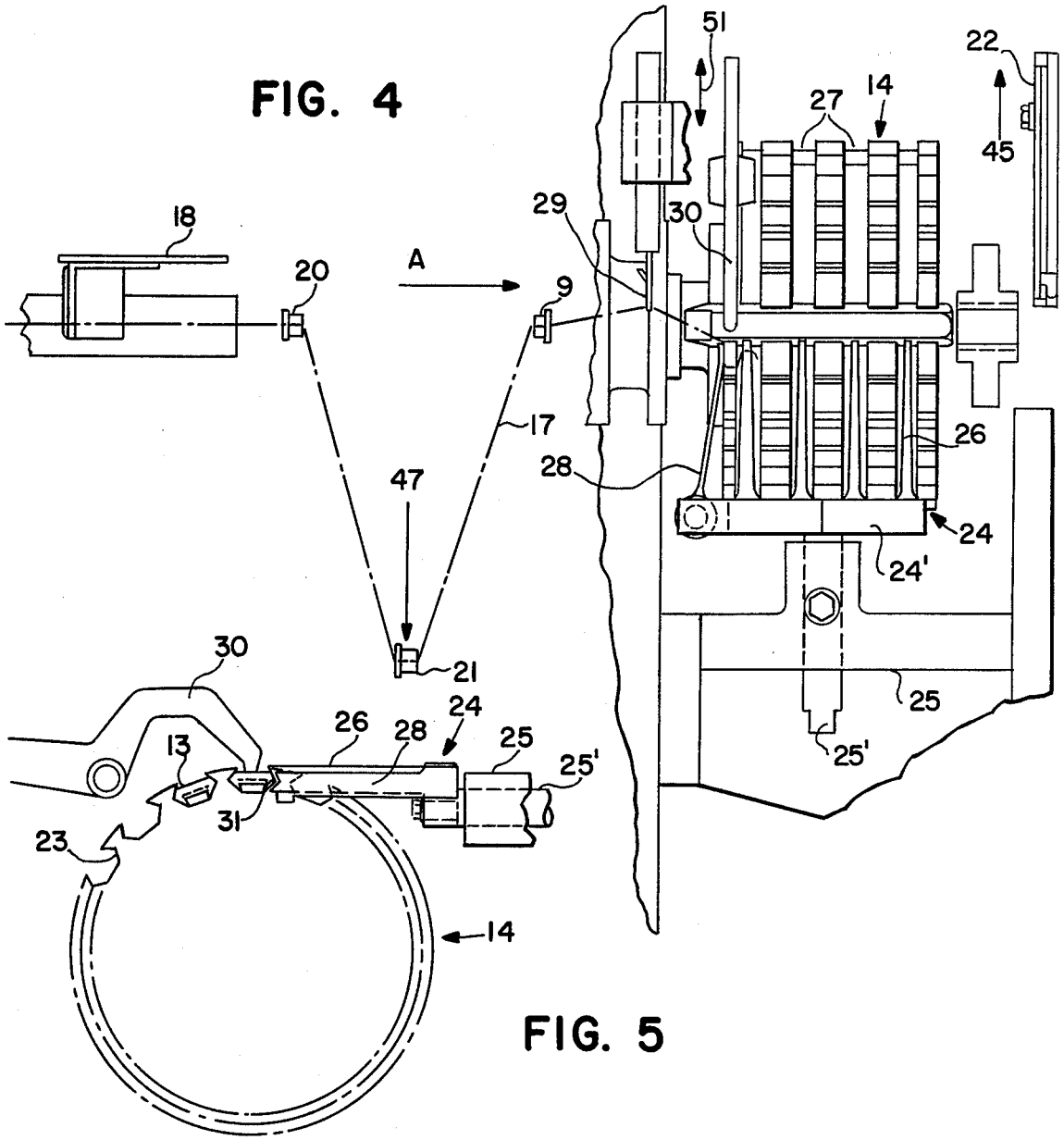
FIG. 5
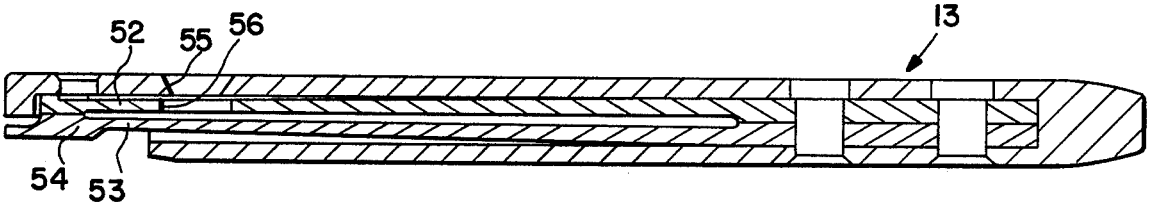
FIG. 6

METHOD AND APPARATUS FOR TRANSFERRING THE WEFT

FIELD OF THE INVENTION

This invention relates generally to a loom with sliding shuttles, and more particularly to a method and apparatus for retracting the cut end of the weft, after the weft is introduced into the shed by a sliding shuttle, and transferring that end of the weft to a subsequent shuttle.

DISCUSSION OF THE PRIOR ART

In known looms the weft is held under tension by a partial movement of a storage lever after the weft has passed through and beyond the fabric shed opposite to the side of the feed. The weft placed under tension in this way is grasped on the feed side by a gripping device located in the vicinity of the lateral edge of the fabric and is cut by a cutter or a knife. In order to be sure that no part of the weft is lost, mechanisms have been provided to grasp the weft end not only by means of the subsequent sliding shuttle but also to re-use that part of the weft extending between the point at which the weft was cut off and the point at which the weft is secured by the new shuttle. In the known looms a clamp for the weft transfer secures the weft before it is cut off by means of the cutter. After it is cut off, the weft moves back to the clamping point of the next sliding shuttle. In order to keep the weft under tension as it moves back, the storage lever which gave tension to the weft inserted in the shed performs an additional movement.

SUMMARY OF THE INVENTION

An object of the invention is to simplify the transfer process for the weft end and to eliminate the clamp required for the weft transfer, thereby leading to a greater speed of operation and more time for the transfer of the next sliding shuttle into the feed position. According to the invention, the thread end is retracted into a recess up to the intake side of the supply drum and is pivoted into the open shuttle clamp, after which the latter is closed.

BRIEF DESCRIPTION OF THE DRAWING

The objects, advantages and features of the present invention will be readily apparent from the following detailed description when taken in conjunction with the accompanying drawing in which:

FIG. 2 is a partially broken away top view of the loom of FIG. 1 showing the area of the supply drum at a time when the weft has been cut adjacent the selvage and the next shuttle has been moved into shooting position;

FIG. 3 is an end view of the supply drum in the position of FIG. 2;

FIG. 4 is a top view similar to FIG. 2 when the weft is transferred to the next shuttle;

FIG. 5 is an end view of the supply drum in the position of FIG. 4; and

FIG. 6 is a sectional side view of a shuttle used in the loom of this invention.

DETAILED DESCRIPTION OF THE PREFERRED EMBODIMENT

Figure 1:
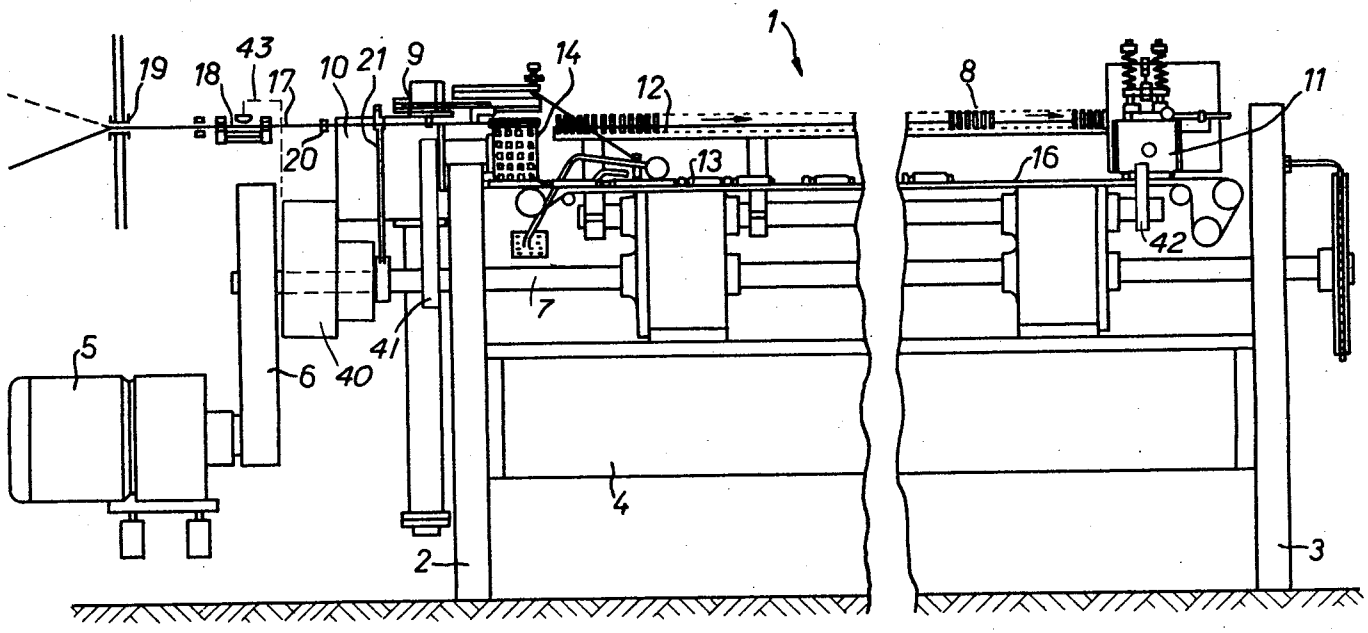
FIG. 1 is a side view of a schematically represented loom with sliding shuttle.

With reference now to the drawing, FIG. 1 shows a loom 1 which has a machine frame substantially comprising two side plates 2, 3 and a main web 4 connecting the two side plates. A geared motor 5 is provided relative to side plate 2 and by means of a belt drive 6 drives a longitudinal to shaft 7, normally referred to as the main shaft, mounted in the machine frame. All the parts necessary for the operation of the loom 1 are continuously or intermittently driven under the impetus of the main shaft. Such driven elements include the warp beam, warp, shafts and fabric beam for winding on the fabric. The main shaft 7 correspondingly drives or actuates the shooting device 10, securing device 11 and sley 12, all in a conventional manner. For example, drive means 40 couples shaft 7 to shooting device 10, means 41 controls the operation of the supply drum, and drive means 42 controls securing device 11. All of these means are conventional, means 41 typically comprising a chain drive and a Maltese cross transmission for stepwise rotation of the drum.

The sliding shuttles 13 are brought into their shooting position by a rotary supply drum 14 and are shot by means of the shooting device 10 through shuttle guides 8 arranged on the sley 12 and through the particular open shed. At the other end of the machine the shuttles are braked by the securing device 11, are placed top downwards by a guide shaft (not shown) on a conveyor belt 16 and are thereby brought back to the supply drum 14. Prior to shooting the sliding shuttle 13, a weft 17 which originates from a fixed weft bobbin located outside the shed, is fed through weft guides 19 and weft brake 18 and is inserted into the sliding shuttle 13 which is ready for shooting. However, a storage lever 21 is interpositioned between brake 18 and drum 14 as will be explained in greater detail with reference to FIGS. 2 to 5. The basic operation of the loom as outlined above is well known.

FIG. 2 shows a gripping and cutting device 22 positioned immediately alongside the fabric having just cut off the weft 17 which has been inserted into the shed. Device 22 is of conventional structure. It moves in the direction of arrow 44, grips the just inserted weft while it is taut, cuts it adjacent the material selvage and then releases the weft and moves out of the way of the direction of arrow 45 (FIG. 4) while the loom performs the beating-up step. The drum 14 is simultaneously rotated by one pitch so that a new sliding shuttle 13 arrives in the shooting position. The weft extends from the cut end through the guide slot 23 of drum 14. Guide slots 23 are those longitudinal slots in the drum which retain shuttles 13. When a shuttle grips the weft and is shot through the sley the weft trails through the slot 23 from which the shuttle was just shot and remains therein when cut by device 22. The drum is formed with spaced circumferential grooves 27 which intersect with and have the same depth as guide slots 23. An arm 25 is fixed to the machine frame. A shaft 25' connects guide comb 24 to the arm 25, the guide comb having a plurality of fingers 26 projecting from carrier bar 24'. The guide comb is located on the empty side of the supply drum 14, that is, that side whose guide slots carry no sliding shuttles. The guide comb 24 fingers 26 project into and ride in the spaced annular peripheral grooves 27 of drum 14. As can be seen in FIG. 2, the fingers 26 extend against the next shuttle 13 which is ready for shooting.

The free end of each of the fingers is formed as a V-shaped groove 31, corresponding to the shape of the side of the shuttle, in which the end of the cut weft 17 is guided. The weft is thus frictionally held against the shuttle 13 in shooting position by groove 31. As a result of this arrangement, rotation of the drum, combined with guidance of the weft end in grooves 31, provides controlled relocation of the weft from empty guide slot 23 to the next shuttle. Note how the weft loops alternately from a portion of empty slot 23 to groove 31 in peripheral groove 27 of the drum.

Prior to the cutting off of weft 17 by the device 22, the storage lever 21, through which the weft passes, is moved in the direction of arrow 46 in FIG. 2 by part of its stroke in order to place the weft still held by the shuttle in securing device 11 under tension before beat-up and changing the shed. At this time weft brake 18 applies a certain amount of friction to the weft so that lateral motion of the storage level away from its normal position in line with weft guides 20 and 9 causes the weft in the shed to be in tension. At the time that the weft is cut by device 22, weft brake 18 firmly grips the weft. Further motion of the storage lever 21 as shown in FIG. 4 by arrow 47 then pulls the end of the weft through slot 23 and grooves 31 and past arm 28 which frictionally holds the weft against the inlet or left face of the drum. The retaining arm 28 is simply an arm having a surface which bears against the inlet or left face of the supply drum. The frictional engagement of the weft in and against the drum is relatively light so that it easily slides through due to the motion of lever 21. A connecting dot-dash line 43 in FIG. 1 is shown coupling the main shaft to the weft brake, indicating that its operation is synchronized with the other operations of the loom. Since during this movement the weft is secured as it comes from the bobbin by the weft brake 18, the cut off weft end in the guide slot 23 is retracted to such an extent that only a small portion thereof remains in the slot 23, as shown in FIG. 4, and that portion is pressed by a retaining arm 28 against the inlet face of the supply drum 14. This is simultaneously accompanied by a movement of a guide hook 29 which draws the weft end into the shuttle clamp opened by a ram 30 (FIG. 4), the clamp being located on the back of the sliding shuttle 13. This terminates the transfer of the weft end to the sliding shuttle 13 which is ready for shooting. As shown in FIG. 3, ram 30 is pivoted back so that the shuttle clamp closes and the weft end is secured. The guide hook 29 is simultaneously brought into the aligned position with the weft guides 20 and 9 and the weft brake 18 is released, followed by the shooting of sliding shuttle 13 by shooting device 10 and the insertion together with the weft 17 into the shed. Only a small piece of weft end is left free which is held by the retaining bolt 28.

Storage lever 21 is merely an arm which is cam or gear controlled from shaft 7. The loop in the weft formed by lever 21 by means of the operating step shown in FIG. 4 is absorbed immediately when the shuttle is shot through the shed. Guide hook 29 is a conventionally shaped hook through which the weft passes. The hook moves in a reciprocating manner as indicated by arrow 51 in FIG. 2. When moved to the position shown in FIG. 4, the weft is pulled into engagement with the clamp of shuttle 13.

The shuttle is conventional and is shown in FIG. 6. The clamp is comprised of upper blade 52 and lower blade 53 which come together at end 54 and engage the weft at that point. Lower blade 53 is biased to normally contact upper blade 52. A hole 55 is provided in the shuttle body in alignment with hole 56 in the upper blade. Ram 30 which has a relatively small pointed end enters through these holes and presses lower blade 53 downward to separate the blades at end 54. This occurs at about the time storage lever 21 reaches its farthest point of travel as shown in FIG. 4 and is immediately followed by the motion of the guide hook as shown in the same figure. The weft is thus inserted into the shuttle clamp and ram 30 is then pivoted out of the way allowing the clamp to close. The shuttle is then shot through the shed. The motions of the guide hook and the ram are controlled by the main shaft in conventional manner and it would serve no useful purpose to show the various connecting means in detail here.

Due to the fact that the guide slot of the particular sliding shuttle shot is used for guiding the weft end, a very simple and reliable guidance of the weft end is obtained and no additional holding devices are required.

The invention is not limited to the embodiment described above and various modifications will likely occur to those skilled in this art which are within the scope of the invention.

What is claimed is:

1. A method for transferring the cut end of a weft to a second shuttle in a loom with sliding shuttles, each of said shuttles having a clamp to engage the weft, the weft having been introduced into the shed by means of a first shuttle and subsequently cut adjacent the shed on the intake side thereof, said loom further including a shuttle supply drum with a plurality of guide slots adapted to carry said shuttles into shooting position, said weft extending from a supply bobbin through a storage lever to the intake side of said drum and through one of said guide slots to a point adjacent the intake side of the shed, said method comprising the steps of:

rotating said drum to position said second shuttle in shooting position;

frictionally engaging that portion of the weft extending through the first guide slot from which said first shuttle was shot;

retracting the weft, by moving said storage lever, through said first guide slot to a point whereby the cut end of the weft remains in said first guide slot adjacent the intake side of said drum;

holding the weft adjacent the cut end thereof against the inlet face of said supply drum adjacent the clamp of said second shuttle;

opening the shuttle clamp in said second shuttle;

positively laterally drawing a portion of the weft adjacent the cut end thereof into said second shuttle clamp by means of a guide hook; and closing said second shuttle clamp thereby securing the cut end of the weft therein.

2. The method recited in claim 1 wherein said frictionally engaging step comprises forcing the weft against said second shuttle in shooting position by means of a guide comb having fingers conforming to and adapted to engage the side of said second shuttle.

3. Apparatus for transferring the cut end of a weft to a shuttle shooting position in a loom with sliding shuttles, each of said shuttles having a clamp to engage the weft, the weft being supplied from a bobbin to the intake side of said loom, said apparatus comprising:

a drum rotatably mounted to said loom and being formed with a plurality of longitudinal guide slots and a plurality of longitudinally spaced annular peripheral grooves;

a shuttle in at least some of said guide slots;

a storage lever pivotally mounted to said loom between said bobbin and said drum, the weft passing through said storage lever to the intake side of said drum and through an empty one of said guide slots adjacent said shuttle in shooting position terminating in said cut end at a point adjacent the shed;

a guide comb mounted to said loom having a plurality of fingers, each said finger projecting into one of said annular grooves, the distal end of each said finger engaging the weft, said comb being so positioned that when said drum rotates to place said next shuttle in shooting position, the weft residing in said guide slot is frictionally held against the side of said next shuttle; and means adjacent the intake side of said drum for drawing a portion of the weft adjacent the cut end thereof into the shuttle clamp of said shuttle in shooting position.

4. The apparatus recited in claim 3 and further comprising a retaining arm for frictionally securing the cut end of the weft against the intake side of said drum.

5. The apparatus recited in claim 3 wherein said drawing means comprises a guide hook normally on the weft axis adjacent said retaining arm, said guide hook being pivotable away from said retaining arm.

6. The apparatus recited in claim 3 wherein said distal end of each of said fingers is formed with a V-shaped groove in which the weft resides and which is configured to engage the side of said shuttle.

* * * * *